US005292426A

United States Patent [19]

Holland et al.

[11] Patent Number: 5,292,426

[45] Date of Patent: Mar. 8, 1994

[54] WAX CONVERSION PROCESS

[75] Inventors: John B. Holland, Port Arthur; Gerald F. Prescott, Bridge City; Dann G. Roy, Nederland; Avilino Sequeira, Jr., Port Arthur; James R. Whiteman, Beaumont, all of Tex.

[73] Assignee: Texaco Inc., White Plains, N.Y.

[21] Appl. No.: 779,471

[22] Filed: Oct. 18, 1991

[51] Int. Cl.[5] ..... C10G 73/38; C10G 47/20

[52] U.S. Cl. ..... 208/111; 208/24; 208/27; 208/46; 208/59

[58] Field of Search ..... 208/27, 111, 59

[56] References Cited

U.S. PATENT DOCUMENTS

| | | | |
|---|---|---|---|
| 4,139,494 | 2/1979 | Itoh et al. | 208/27 |
| 4,148,711 | 4/1979 | Holter | 208/27 |
| 4,186,078 | 1/1980 | Itoh et al. | 208/27 |
| 4,440,630 | 4/1984 | Oleck et al. | 208/111 |
| 4,547,283 | 10/1985 | Neel et al. | 208/27 |
| 4,758,544 | 7/1988 | Plesko et al. | 208/111 |
| 5,098,551 | 3/1992 | Bertaux et al. | 208/111 |

*Primary Examiner*—Helane Myers

*Attorney, Agent, or Firm*—James J. O'Loughlin; Carl G. Seutter

[57] ABSTRACT

Hydrocarbon lube boiling range stock of high Pour Point may be catalytically hydrotreated to yield a product of high viscosity index and reduced Pour Point which is suitable as a lube base oil.

18 Claims, No Drawings

WAX CONVERSION PROCESS

FIELD OF THE INVENTION

This invention relates to a wax conversion process. More particularly it relates to a process for converting a waxy hydrocarbon feedstock of high pour point to a hydrocarbon product of reduced wax content and high viscosity index which is particularly suitable for use as an automatic transmission fluid, premium motor oil, etc. The product oil is particularly characterized by very good low temperature properties and by a high viscosity index.

BACKGROUND OF THE INVENTION

As is well known to those skilled in the art, suitable heavier hydrocarbons may be employed as charge stock for various products including lubricating oils, automatic transmission fluids, etc. Commonly, however, it is found that the charge stocks need considerable processing in order to make them suitable as a base oil for such uses. Various processes may be employed to convert these charge oils into base stocks characterized by decreased wax content, decreased pour point, decreased aromatics content, etc.

There is a large body of literature and patents which address this area. Typical of these are the following:

Bijward, H. M. J. et al *The Shell Hybrid Process, an Optimized Route for HVI (High Viscosity Index) Lube oil Manufacture* paper from Pet. Ref. Conf. of the Jap. Pet. Inst 27–28 Oct. 1986, p16;

Bulls, S. et al *Lube oil Manufacture by Severe Hydrotreatment* Proc. Tenth World Pet. Congress Vol 4, 1980 p221–8.

| |
|---|
| U.S. Pat. No. 3,268,439 |
| U.S. Pat. No. 3,658,689 |
| U.S. Pat. No. 3,764,516 |
| U.S. Pat. No. 3,830,723 |
| U.S. Pat. No. 4,547,283 |
| U.S. Pat. No. 4,900,711 |
| U.S. Pat. No. 4,911,821 |
| EUR 0 321 299 |
| EUR 0 321 302 |
| EUR 0 335 583 |
| BRIT 1,098,525 |

Continuing studies are in progress in an attempt to improve the quality of base stocks so that they may be employed as premium motor oils, transmission fluids, etc. There is also a need to process sulfur-containing charge to prepare satisfactory product—without hydrotreating. It is also found that there is a need to treat charge stock such as slack wax, typically containing substantial content of sulfur (above 100 ppm) and paraffins in order to permit attainment of product oils (suitable for such desired uses) characterized by high viscosity index (typically 120–150) and reduced or low pour point at mid-range viscosity (typically ≦300 SUS @100° F.).

It is an object of this invention to provide a process for treating a waxy hydrocarbon such as slack wax to convert it into a product oil containing decreased content of normal paraffins and increased content of isoparaffins. Other objects will be apparent to those skilled in the art.

STATEMENT OF THE INVENTION

In accordance with certain of its aspects, this invention is directed to a process for converting a waxy hydrocarbon charge of high Pour Point and containing at least 100 ppm sulfur and at least about 40 w % paraffins to a hydrocarbon product, of reduced Pour Point and high viscosity index, suitable for use as a lube oil base stock which comprises maintaining a bed of sulfur-tolerant supported catalyst containing 2–10 w % non-noble Group VIII metal, 5–30 w % Group VI B metal, 0–2 w % phosphorus, and 0–10 w % of halogen, characterized by a Total Surface Area of 100–250 $m^2/g$ and a pore size distribution as follows:

| Pore Size | Pore Volume cc/g |
|---|---|
| <100Å | 0.20–0.50 |
| 100–160Å | 0.01–0.05 |
| >160Å | 0.01–0.10 |

and a Pore Mode of 60Å–100Å diameter;

passing waxy hydrocarbon charge of high Pour Point and containing at least 100 wppm sulfur and at least about 40 w % paraffins to said bed of catalyst;

maintaining said bed of catalyst at wax conversion conditions including temperature of 550° F-900° F, pressure of 300–5000 psig, space velocity LHSV of 0.1–10, and hydrogen feed rate of 500–10,000 SCFB thereby converting said waxy hydrocarbon charge of high Pour Point and containing at least about 100 wppm sulfur and at least about 40 w % paraffins to a hydrocarbon product, of reduced Pour Point and high viscosity index, suitable for use as a lube oil base stock; and recovering said hydrocarbon product of reduced Pour Point and high viscosity index suitable for use as a lube oil base stock.

DESCRIPTION OF THE INVENTION

The waxy hydrocarbon charge which may be treated by the process of this invention includes those which are particularly characterized by a high content of wax - typically at least about 40% and commonly above 55 w % paraffins. These charge compositions contain 40–95 w %, commonly 55–95 w %, say 85 w % paraffins. They may also be characterized by a high pour point—typically above about 80° F., commonly 80° F.–120° F. say 90° F. In the case of slack wax, the pour point may be even higher—say up to 150° F. These stocks may commonly contain sulfur in amount of >100 wppm i.e. greater than 0.01 w %.

These charge hydrocarbons may typically be obtained as side streams from a vacuum tower; and they will commonly not have been subjected to further processing. Charge compositions may also include slack wax or petrolatum recovered from a dewaxing operation, soft wax, wax distillates recovered from non-lube waxy crudes (e.g. Minas, Altamont etc). Other possible feedstocks may include raffinates from solvent refining of high wax content wax distillates including those recovered during refining with N-methyl pyrrolidone-2, furfural, phenol, etc. It is also possible to treat soft waxes obtained from deoiling of (i) slack wax, (ii) high wax content distillates or (iii) deasphalted oil. Solvent extracted streams such as distillates or deasphalted oils may be treated by the process of this invention.

It is a feature of the process of this invention that it is particularly adapted to permit operation with non-conventional charge containing much higher wax content (e.g ≧ 40 w %) than is present in conventional charge to hydrotreating—which latter charge commonly contains less than about 30 w % wax.

Illustrative specific waxy hydrocarbon charge stocks which may be treated by the process of this invention may include the following:

TABLE

| Test | A Unrefined Minas 7 Dist | B Unrefined Minas 8 Dist | C Solvent Ref. Minas 8 Dist | D Slack Wax 20 | E Slack Wax 40 | F Petrolatum | G Soft Wax |
|---|---|---|---|---|---|---|---|
| API Gravity | 35.0 | 31.9 | 33.0 | 38.0 | 36.4 | 31.4 | 34.8 |
| Nitrogen, ppm | 344 | 458 | 56.6 | 18.1 | 29.8 | 231 | 28.4 |
| Sulfur, wt % | 0.08 | 0.2 | 0.102 | 0.05 | 0.37 | 0.32 | 0.026 |
| Wax Content | 49.0 | 45.5 | 50.4 | 89.1 | 87.1 | 88.5 | 41.5 |
| Vis. Kin. cSt | | | | | | | |
| @ 65.6° C. | 8.24 | 13.18 | 11.28 | 11.00 | 18.26 | 53.47 | 14.3 |
| 100° C. | 4.01 | 5.76 | 5.24 | 5.36 | 8.19 | 19.17 | 6.23 |
| VI | 129 | 125 | 146 | 179 | 175 | 141 | 132 |
| Visc., SUS @ 100 F. | 93 | 163 | 133 | 119 | 211 | 803 | 176 |
| GC TBP F.° | | | | | | | |
| IBP | 548 | 559 | 556 | 654 | 513 | 790 | 668 |
| 10% | 687 | 776 | 773 | 786 | 870 | 931 | 775 |
| 50% | 792 | 848 | 850 | 881 | 968 | 1037 | 877 |
| 90% | 863 | 897 | 902 | 973 | 1031 | 1118 | 952 |
| EP | 923 | 948 | 1336 | 1059 | 1116 | 1178 | 1169 |

It is a feature of the process of this invention that it may be carried out in one or more separate beds in one reactor or in several reactors. In the case of wax distillate charge, the reaction may be carried out in two or more beds after the first of which, diluent (e.g. hydrogen or additional charge hydrocarbon) may be admitted to control the exotherm i.e. to maintain the temperature of the reaction mixture within the noted range. In the case of e.g slack wax, the exotherm is not normally so large as to require inter-bed cooling or addition of diluent.

The supported catalyst which may be employed in the process of this invention may contain 2–10 w % non-noble Group VIII metal, 5–30 w % Group VI B metal, 0–2 w % phosphorus, and 0–10 w % halogen. The total metal content may be 10 w %–35 w %, preferably 20 w %–30 w %, say 25 w % of the support. The atomic ratio of Group VIII metal to Group VIB metal is preferably 0.5–2:1, more preferably 0.05–1.5:1, typically 0.75–1.25, say about 1:1.

The supported catalyst may contain 0–10 w % halogen preferably 0.5–10 w %, more preferably 0.5–7 w %, typically 0.5–5 w %, say about 2 w %. Phosphorus may be present in amount of 0–2 w %, say 0 w %.

The support typically may contain 0.5–15 w %, say 15 w % silica and 85–99.5 w %, say 85 w % alumina.

The catalyst which may be employed in the process of this invention may be a sulfur-tolerant supported (on 15% silica/85% alumina support) catalyst containing:

(i) a non-noble Group VIII metal (Fe, Co, or Ni) in amount of 2–10 w %, preferably 3–8 w %, say 6 w %

(ii) a Group VI B metal (Cr, Mo, or W) in amount of 5–30 w %, preferably 10–25 w %, say 19 w %

(iii) phosphorus in amount of 0–2 w %, preferably 0–2 w %, say 0 w %.

(iv) halogen (Cl, Br, I, or preferably F) in amount of 0–10 w %, preferably 0.5–10 w %, say 2 w %.

The supported catalyst which may be employed may be formed on a support of silica, alumina, silica-alumina, magnesia, magnesia-alumina, etc by contacting the formed support with an aqueous solution of a water-soluble composition of one component (e.g. Group VIII metal), drying, and calcining followed by contacting with an aqueous solution of a water-soluble composition of another component (e.g. Group VI B metal) drying, and calcining. Haliding may be effected by contacting the support as with an aqueous solution (e.g. of fluosilic acid), drying, and calcining.

It is preferred, however, to prepare the catalyst by blending the components prior to e.g. extrusion. In this preferred embodiment, the catalyst may be formed by extruding an aqueous mixture (in amounts corresponding to those set forth supra) containing silica, alumina, fluorine (as from fluosilic acid) and when desired phosphorus. The catalyst may then be dried at 100° C.–200° C., say about 125° C. for 12–24 hours, say about 18 hours and then calcined at 400° C.–600° C., say about 500° C. for 0.5–4, say 1 hour.

The catalyst so-prepared is characterized by a Total Surface Area of 100–250 $m^2/g$ and a Pore Size Distribution as follows:

TABLE

| Pore size | Pore Volume cc/g |
|---|---|
| <100Å | 0.20–0.50 |
| 100–160Å | 0.01–0.05 |
| >160Å | 0.01–0.10 |

and a Pore Mode of 60-100Å Diameter

Illustrative catalysts which may be employed may be characterized as follows:

| Property | A | B | C | D |
|---|---|---|---|---|
| Nickel w % | 6 | 3 | 5 | 6.5 |
| Molybdenum w % | | 13 | 15.5 | |
| Tungsten w % | 19 | | | 19.4 |
| Fluorine w % | 2 | | | 3.4 |
| $SiO_2$ | 13.5 | | 49 | 2.5 |
| $Al_2O_3$ | 45.0 | 84 | 38 | |
| Surf. Area $m^2/g$ | 152 | 162 | | 126 |
| Total Pore Vol cc/g | 0.42 | 0.47 | | 0.38 |
| Av. Pore Diameter Å | 72 | | | |
| Crush Strength (lbs) | 20 | 24 | 30 | 15.8 |
| Av. Diameter (inch) | 0.063 | | 0.070 | 0.062 |
| Av. Length (inch) | 0.217 | | 0.30 | 0.13 |
| Density Loaded lbs/$ft^3$ (packed) | 61.2 | 52.5 | 49.9 | 62.4 |

In practice of the process of this invention, the waxy hydrocarbon charge of high Pour Point and containing at least about 40 w % of paraffins is charged to the bed of catalyst. Reaction conditions include temperature of 550° F.-900° F., preferably 725° F.-800° F., say about 750° F., pressure of 300-5000 psig, preferably about 1000-1500, say about 1000 psig, LHSV of 0.45-0.60, preferably 0.50-0.60, say about 0.5, and hydrogen feed rate of 500-10,000, say 2500 SCFB.

During contact with catalyst at the conditions of operation, the hydrocarbon charge is subjected to wax conversion reactions the principal one of which appears to be isomerization of normal paraffins to isoparaffins. The degree of conversion may be measured by the decrease in content of material (i.e. wax) which crystallizes out on chilling in the presence of dewaxing solvent as measured by Test Method ASTM D-3235 or ASTM D-721 or ASTM D-1601, as appropriate.

It is a particular feature of the process of this invention that these improvements may be attained at a high Reaction Yield—typically above about 25 w % and commonly 40-60 w %, say about 50 w %. (Reaction Yield, or wax-free Lube Yield, is defined as the product of the 700° F.+bottoms yield in weight % times the oil content weight fraction).

attainment to greater degree of one or the other of these desiderata. For example, if one is primarily interested in improvement in Pour Point (i.e. production of product of low Pour Point), then operation should typically be carried out to attain product having an oil content above about 80 w %.

Although the conditions to attain this end may be different for different charge stocks, they may preferably include temperature of say 750° F.-850° F., pressure of say 400-2400 psig. LHSV of 0.45-0.55 and hydrogen feed rate of 2500 SCFB.

When it is desired to operate in a manner to attain high Reaction Yield (700+° F. Wax Free Yield) with satisfactory Pour Point, operation may be carried out to attain product having an oil content below about 80 w %, say 70%-80%. The conditions to attain this oil content will vary for different charge stocks—but generally it will mean operation at a temperature of about 20° F.-30° F., say 25° F. below that at which low Pour Point is attained i.e. at temperature of say 725° F.-825° F. at essentially the same pressure and space velocity.

Typical results attained when it is desired to attain product of low Pour Point may be as follows:

TABLE

| Conditions | A Unrefined Minas 7 Distillate | B Unrefined Minas 8 Distillate | C Solvent Ref. Minas 8 Distillate | D Slack Wax 20 | E Slack Wax 40 | F Petrolatum | G Soft Wax |
|---|---|---|---|---|---|---|---|
| Reactor Temp, F. | 826 | 826 | 800 | 771 | 775 | 801 | 775 |
| Reactor Pressure, psig | 996 | 997 | 998 | 997 | 1001 | 998 | 1008 |
| Space Velocity, LSHV | 0.55 | 0.53 | 0.55 | 0.53 | 0.55 | 0.55 | 0.50 |
| Test | | | | | | | |
| Viscosity, SUS @ 100 F. | 58 | 66 | 66 | 66 | 89 | 165 | 61 |
| Viscosity Index | 131 | 145 | 130 | 135 | 144 | 171 | 112 |
| Pour Point, F. | 25 | 25 | 20 | 25 | 55 | 95 | 0 |
| Reactor Yield, Wt % (700+ F. Wax Free Yield) | 23.3 | 24.2 | 29.3 | 40.4 | 40.3 | 39.2 | 18.1 |
| Oil Content w % of Product | 80.2 | 75.9 | 91.3 | 94 | 89.8 | 63.4 | 98 |

TABLE

| Conditions | A Unrefined Minas 7 Distillate | B Unrefined Minas 8 Distillate | C Solvent Ref. Minas 8 Distillate | D Slack Wax 20 | E Slack Wax 40 | F Petrolatum | G Soft Wax |
|---|---|---|---|---|---|---|---|
| Reactor Temp, F. | 800 | 801 | 775 | 750 | 751 | 801 | 750 |
| Reactor Pressure, psig | 995 | 993 | 998 | 1004 | 1000 | 998 | 1006 |
| Space Velocity, LSHV | 0.54 | 0.53 | 0.53 | 0.58 | 0.58 | 0.55 | 0.49 |
| Test | | | | | | | |
| Viscosity, SUS @ 100 F. | 65 | 73 | 81 | 89 | 137 | 165 | 85 |
| Viscosity Index | 131 | 144 | 139 | 151 | 172 | 171 | 133 |
| Pour Point, F. | 95 | 90 | 85 | 95 | 120 | 95 | 70 |
| Reactor Yield, Wt % (700+ F. Wax Free Yield) | 31.2 | 41.4 | 44.0 | 56.9 | 50.3 | 39.2 | 52.4 |
| Oil Content w % of product | 65.7 | 66.9 | 72.2 | 77.8 | 61.8 | 63.4 | 83 |

In practice of the process of this invention, it is possible to direct the course of the reaction to attain either low Pour Point or high Reaction Yield; although both of these factors may be improved over the noted range of reaction conditions (including temperature, pressure, and space velocity), it is possible by operating at desired points within the range to direct the reaction to permit From the above Table, it is apparent that it is possible to prepare a low pour point product which is characterized by satisfactory viscosity and viscosity index. It is also possible to operate in manner to obtain improved Reactor Yield.

It is a feature of the process of this invention that the high viscosity index product recovered by treating e.g a slack wax is typically characterized as follows:

(i) decrease in wax content from a charge value of typical 85–90 w %, say 90 w % to a product wax content of 5–85 w %, say 20–25 w % at optimum yield, and (ii) decrease in Pour Point from a charge value of typically ≧120° F. to a product Pour Point as low as 25° F., and typically 40°–45° F.

It is a feature of the process of this invention that the product recovered by treating high wax distillate charge or a high-wax-content non-lube crude charge (such as a Minas) is characterized by:

(i) increase in viscosity index from a charge value of typically 120–130, say 125 to a product viscosity index of 130–150, say 140;

(ii) decrease in wax content from a charge value of typically 45 w % to a product wax content of 10–40, say 20 w %; and (iii) decrease in Pour Point from a charge value of typically >120° F. to a product Pour Point of 25° F.–90° F., say 40° F.

It is also a feature of the process of this invention that the high viscosity index product recovered by treating petrolatum is characterized by:

(i) increase in viscosity index from a charge value of 130–150, say 140 to a product viscosity index of 155–190, say 170 (waxy oil basis);

(ii) decrease in wax content from a charge value of 80–90 w %, say 90 w % to a product wax content of 25–75 w %, say 35 w %; and (iii) decrease in Pour Point from a charge value of ≧120° F. to a product Pour Point of 80° F.–120° F.

It is also a feature of the process of this invention that the product recovered by treating a soft wax (obtained from deoiling of slack wax to make hard wax—the soft wax containing a substantial portion of oil) is characterized by:

(i) decrease in wax content from a charge value of 30 w %–50w %, say 40 w % to a product wax content of 2 w %–28 w %, say 20 w %; and (ii) decrease in Pour Point from a charge value of 90° F.–120° F.+, say 110° F. to a product having a Pour Point of 0° F.–90° F., say 70° F.

It will be apparent that the undewaxed products of the process of this invention may be improved generally with respect to Pour Point and wax content or Viscosity Index—depending upon the feed used. When it is desired to utilize product as a lube oil stock, it is highly desirable to thereafter subject the stock to solvent refining and dewaxing or catalytic dewaxing in order to obtain a product of sufficiently low wax content to attain the desired Pour Point. It is a feature of this process that in the case of some of the charge stocks (such as petrolatum or slack wax), it is found that it is possible to carry out solvent dewaxing on the treated products since a portion of the wax has been converted to oil and the oil content is now within the operating range of the solvent dewaxing operation. Previously it was not found to be economically feasible to subject such stocks to solvent dewaxing. The solvent dewaxed material may be solvent extracted to effect stabilization. Alternatively the product may be subject to solvent refining and catalytic dewaxing (in either order) and/or to high pressure stabilization.

It is a particular feature of the process of this invention that it is possible, by use of non-noble metal catalyst, to process sulfur-containing feedstocks without the need to employ a guard bed as is required by some prior art techniques.

It is also a particular feature of the process of this invention that (unlike prior art treating processes) it is possible, by use of a two-reactor train having a second reactor temperature about 100° F.–300° F., say 200° F. lower than the temperature of the first (the second reactor typically being at 500° F.–600° F., say 550° F.) to attain product unexpectedly characterized by substantially improved ultraviolet light (UV) stability. This increase in UV stability may be by a factor of much as ≧10 and commonly by as much as 8–15 days. Prior attempts to hydrocrack and stabilize in a single train system without intermediate separation (i.e. fractionation or flashing to remove light gases such as hydrogen, hydrogen sulfide, or ammonia) prior to stabilization have not permitted attainment of product of significantly improved UV stability. Note e.g. Example XX–XXV infra.

In practice of the process of this invention, use of, higher pressures (e.g. ≧ca 1500 psig) within the operating range permits attainment of substantially improved UV stability—i.e. by a factor of three or more.

It is particularly surprising to be able to attain product oils which are characterized by such high viscosity index at such high reactor yield by use of a non-noble Group VIII catalyst. Prior art processes are particularly characterized by either lower Reactor Yield or by the fact that they require more restrictive feedstock or require feed hydrotreating to remove sulfur. It is a particular feature of the process of this invention that it is possible to improve the properties of a wide range of feedstocks—ranging from wax distillates to slack waxes without hydrotreating of the feed to remove sulfur and nitrogen compounds.

Practices of the processes of this invention will be apparent to those skilled in the art from the following description of illustrative examples.

DESCRIPTION OF SPECIFIC EMBODIMENTS

Example I

In this Example, which represents the best mode presently known of carrying out the process of the invention, the hydrocarbon charge is a slack wax 20 characterized by the following properties.

TABLE

| Property | Value |
|---|---|
| Wax Content (ASTM D-721) w % | 89.1 |
| Oil Content w % | 10.9 |
| Pour Point °F. | ≧120° F. |
| Viscosity cSt @ 100° C. | 5.3 |

This hydrocarbon charge is unsuitable for use as a lube oil stock because inter alia both the wax content and the Pour Point are undesirably high.

In this Example the catalyst is prepared by mulling together equal parts by weight of the Pural SB brand (of Condea Chemie) boehmite alumina and the Versal 250 brand (of Kaiser Aluminum and Chemical) pseudoboehmite alumina. Water is added to yield a mixture containing 58w% thereof as mixing is continued to give an extrudable mass. Extrudate (cylinders of 0.07 inch diameter) is dried overnight at 125° C. and calcined at 670°–700° C. to yield product characterized as follows:

TABLE

| | |
|---|---|
| $SiO_2$ % | 20 |
| $Al_2O_3$ % | 80 |
| Surface Area $m^2/g$ | 243 |
| Total Pore Volume cc/g | 0.66 |
| Crush Strength lbs | 15 |
| Diameter Inches | 0.063 |

An aqueous solution is prepared containing 746.3 g of ammonium metatungstate and 1996.4 g of nickel nitrate hexahydrate and 295 g of aqueous hydrofluoric acid with mixing.

The resulting solution is diluted with distilled water to a total volume of 3150 cc. This solution is impregnated onto 4500 g of calcined extrudate supra. The so-loaded composition is dried overnite at 125° C. and calcined at 500° C. for one hour. Product catalyst is characterized as follows:

TABLE

| | |
|---|---|
| Nickel | 6% |
| Tungsten | 19% |
| Fluorine | 2% |
| $SiO_2$ | 13.5% |
| Surface Area $m^2/g$ | 152 |
| Total Pore Volume cc/g | 0.42 |
| Crush Strength lbs | 20 |
| Diameter inch | 0.063 |

Wax conversion is carried out at 750° F. and 1004 psig and LHSV of 0.58 on slack wax 20 charge (- see column D of Table supra).

Hydrogen (100% pure) feed rate is 2500 SCFB. Operation is carried out in liquid phase in a single reactor containing a fixed bed.

Product lube base oil is characterized as follows:

TABLE

| | |
|---|---|
| Viscosity, SUS @ 100° F. | 89 |
| Viscosity Index | 151 |
| Pour Point °F. | 95 |
| Reactor Yield w % (700+° F. Wax Free Yield) | 56.9 |

From the above Table, It is apparent that the Pour Point has been decreased from ≧120° F. down to 95° F.; and the Reactor Yield is 56.9 w %. (It should be noted that subsequent processing including dewaxing will decrease the Pour Point to even lower levels).

Product may be recovered and distilled to yield clean by-products. Typical values for these fractionation by-products (including naphtha and top quality kerosene cuts) may be as follows:

Product is recovered and distilled to yield clean by-products including a naphtha ( 3.7 w % of the feed) and a top quality kerosene (5.3 w % of the feed).

TABLE

| | Cut | |
|---|---|---|
| Property | Naphtha | Kerosene |
| RI @ 70° C. | 1.4010 | 1.4180 |
| API Gravity | 55.9 | 49.6 |
| Flash (COC) °F. | 105 | 200 |
| ASTM Color | <1.0 | <1.0 |
| Smoke Point °F. | 33 | 33 |
| Freeze Point °F. | −100 | −60.7 |
| Aniline Point °F. | 155 | 175 |
| Hydrogen w % | 14.90 | 14.75 |
| Cetane No. | 43.4 | 54 |
| IBP °F. | 220 | 359 |
| 5% | 258 | 385 |
| 50% | 328 | 442 |

TABLE-continued

| | Cut | |
|---|---|---|
| Property | Naphtha | Kerosene |
| 95% | 384 | 499 |
| EP | 400 | 514 |

Distillate also includes a 500° F.–600° F. liquid cut (5.3 w % of the feed) which is suitable for use in specialty applications (e.g. a specialty lube oil).

TABLE

| 500° F.–600° F. Cut | |
|---|---|
| Property | Value |
| Flash, UC °F. | 280 |
| Vis., 40° C., cSt | 3.74 |
| Vis., 100° C., cSt | 1.42 |
| Vis., 100° F., SUS | 40 |
| Pour Point °F. | −25 |
| Dielectric Bkd, V | 39,500 |
| Distillation, ep °F. | 627 |
| UV Absorbance, millimicrons | |
| 280–289 | 2.25 |
| 290–299 | 1.59 |
| 300–359 | 0.55 |
| 360–400 | 0.06 |

Distillate also includes a 600° F.–700°0 F. liquid cut (8.5 w % of the feed) as follows:

TABLE

| 600° F.–700° F. CUT | |
|---|---|
| Property | Value |
| Gravity, API | 43.4 |
| Flash (COC) °F. | 325 |
| Vis., 40° C, cSt | 6.94 |
| Vis. SUS @ 100° F. | 50 |
| Unsulfonated Residue, w % | 100 |
| Pour Point °F. | 30 |
| Distillation ASTM-D2887 | |
| IBP °F. | 579 |
| 5% | 603 |
| 10% | 613 |
| 50% | 671 |
| 90% | 716 |
| 95% | 722 |
| EP | 775 |

Distillate also includes the desired 700° F.+ lube cut (73.1 w % of feed) 56.9 w % on wax-free basis) suitable for use as a lube oil base stock after additional processing as follows:

TABLE

| 700° F. CUT | |
|---|---|
| Property | Value |
| Gravity API | 39.2 |
| Flash (COC) °F. | 440 |
| Vis, 65.6° C. cSt | 9.70 |
| Vis, 100° C. cSt | 4.65 |
| Vis SUS @ 100 | 109 |
| VI | 145 |
| Wax Content w % | 13.8 |
| Pour °F. | 45 |
| ASTM Distillation | |
| IBP °F. | 714 |
| 5% | 756 |
| 10% | 768 |
| 50% | 831 |
| 90% | 921 |
| EP | 1009 |

It is apparent that the process of this invention permits conversion of a wide range of feedstocks to a product lube base oil characterized inter alia by a high viscosity index, a substantially decreased wax content, and a substantially decreased Pour Point.

EXAMPLES II-IV

In control Examples II-IV, the procedure of Example I is followed except that the reactor pressure is 1500 psig. The catalyst of Example II is the same as that of Example I. The catalyst of Example III is a commercially available prior art catalyst containing 3 w % nickel and 13 w % molybdenum on gamma alumina. Surface Area is 162 $m^2/g$. Pore Volume is 0.47 cc/g. Compacted bulk density is 52.5 $lbs/ft^3$.

The catalyst of Example IV is another commercially available catalyst; it contains 5 w % nickel and 15.5 w % molybdenum on Y-zeolite. Compacted bulk density is 49.9 $lbs/ft^3$. Crush strength is 30 lbs. Catalyst particles are cylinders 0.3 inches long.

The reactor temperature in Example II is 750° F.; in Example III it is 800° F.; and in Example IV it is 550° F. In Examples II-IV, reactor pressure is 1500 psig.

The results are as follows:

TABLE

| | Finished Base Oil | | |
|---|---|---|---|
| Example | Visc SUS 100° F. | VI °F. Pour | Reactor Yield W % |
| II | 79 | 142 | 50.6 |
| III | 68 | 147 | 28.3 |
| IV | 109 | 123 | 15.7 |

From the above Table, it is apparent that the desired Reactor Yield attained in Example II is much higher than (approximately twice) those of Examples III-IV. Reactor Yield of Example II at 750° F. is better than that of Example III at 800° F. or Example IV at 550° F. It is also to be noted that this unexpectedly high yield of high viscosity index oil is attained by operation at 750° F. (Example II) which is 50° F. lower than the temperature (800° F.) of Example III.

Example V

In Example V, the procedure of Example I is followed except that the catalyst is a commercially available supported catalyst containing 6.5 w % nickel, 3.4 w % fluorine, and 19.4 w % tungsten of Surface Area is 126 $m^2/g$. Pore Volume is 0.38 cc/g. Compacted Bulk Density is 62.4 $lbs/ft^3$. Reactor temperature in Example V is 750° F. and pressure 1000 psig.

TABLE

| | Finished Base Oil | | | |
|---|---|---|---|---|
| Example | Visc SUS 100° F. | VI (0° F. Pour) | Reactor Yield W % | Pressure Psig |
| I | 86 | 142 | 56.9 | 1000 |
| V | 79 | 142 | 50.6 | 1000 |

From the above Table, it is apparent that practice of the process of this invention (Example I) to attain product dewaxed oil (DWO) of 142 VI may be achieved at a reactor yield of 56.9 W %.

Examples VI-XII

In this series of Examples, the charge stocks treated are those set forth following in the charge Stock Table:

TABLE

| Example | Charge Stock |
|---|---|
| VI | A - Unrefined Minas 7 Distillate |
| VII | B - Unrefined Minas 8 Distillate |
| VIII | C - Solvent Refined Minas Distillate |
| IX | D - Slack Wax 20 |
| X | E - Slack Wax 40 |
| XI | F - Petrolatum |
| XII | G - Soft Wax |

Treating is carried out in accordance with the procedure of Example I—but in order to attain low Pour Point, the conditions of operation are: temperature 77? ° F., pressure 997 psig, and LHSV 0.53.

The product oils were tested to determine the viscosity (SUS) 100° F., the Viscosity Index (VI), pour point, and calculated 700+° F. Wax-Free Lube Yield w%.

TABLE

| Example | Temp °F. | Press psig | Viscosity (SUS) 100° F. | VI | Pour Point °F. | Reactor Yield % |
|---|---|---|---|---|---|---|
| VI | 826 | 996 | 58 | 131 | 25 | 23.3 |
| VII | 826 | 997 | 66 | 145 | 25 | 24.2 |
| VIII | 800 | 998 | 66 | 130 | 20 | 29.3 |
| IX | 771 | 997 | 66 | 135 | 25 | 40.4 |
| X | 775 | 1001 | 89 | 144 | 55 | 40.3 |
| XI | 801 | 998 | 165 | 171 | 95 | 39.2 |
| XII | 775 | 1008 | 61 | 112 | 0 | 18.1 |

From the above Table, it is apparent that it is possible to attain product of high viscosity index with desirably reduced Pour Point at high yield. In the case of Example X slack wax 40 (a high viscosity charge stock of high wax content), the wax content has been reduced from 87 w % down to 9.5 w %; and thus this treated high Pour Point charge can readily be dewaxed to yield a high quality, low Pour Point, low wax content lube oil stock.

It should be noted that the viscosities set forth in the above Table are measured on the hydrotreated (non-dewaxed) product which contains material boiling both above and below 700° F. Further dewaxing and fractionation gives the above-reported Reaction Yields of the 700° F. fraction and desirably increases the viscosity of the product to within the desired range of SNO-100 and SNO-200 oils; and the viscosity index will increase further - above the levels presented in the Table.

Examples XIII-XIX

It is thus a feature of the process of this invention that it is possible to operate in manner (note Examples VI-XII supra) to attain product characterized by low Pour Point. When conditions (including economic factors) dictate that operation be carried in a manner to attain high reactor yield for a given charge, this may be readily accomplished. For each charge stock, the conditions which give high Reactor Yield include operation at a temperature of about 25° F. lower than the temperature at which low Pour Point is attained (and at essentially the same pressure and space velocity LHSV). This may be noted from the following Examples XIII--XIX wherein the conditions of Examples VI-XII re duplicated except for temperature.

TABLE

| Example | Temp °F. | Press psig | Viscosity (SUS) 100° F. | VI | Pour Point °F. | Reactor Yield |
|---|---|---|---|---|---|---|
| XIII | 800 | 995 | 65 | 131 | 95 | 31.2 |
| XIV | 801 | 993 | 73 | 144 | 90 | 41.4 |
| XV | 775 | 998 | 81 | 139 | 85 | 44.0 |
| XVI | 750 | 1004 | 89 | 151 | 95 | 56.9 |
| XVII | 751 | 1000 | 137 | 172 | 120 | 50.3 |
| XVIII | 801 | 998 | 165 | 171 | 95 | 39.2 |
| XIX | 750 | 1006 | 85 | 133 | 70 | 52.4 |

From the above Table, it will be apparent that a lowering of temperature of operation by about 25° F. will permit attainment of improved Reactor Yield. For Example, a comparison of Example VI (Run at 826° F.) with Example XIII(Run at 800° F.) shows increase in Reactor Yield from 23.3 w % to 31.2 w %—by a factor of about 34%.

Examples XX-XXV

In this series of Examples, Slack Wax 20 was charged to the reactor containing the catalyst at the conditions noted in the Table below. Examples XXII-XXIII were carried out in two stage operation with a temperature of the first stage of 700° F. and the second stage of 550° F. Example XXIV was also carried out in two stages at temperatures of 700° F. and 500° F. respectively. LHSV in all cases was about 0.5 volumes per volume of catalyst. Catalyst D of the Table supra was employed in Examples XXII-XXIV. Catalyst A was employed in and Examples XX, XXI and XXV.

TABLE

| Example | Stability Days | Reactor Yield w % | Reaction Conditions Temp °F. | Reaction Conditions Pres. psig |
|---|---|---|---|---|
| XX | 3 | 50.1 | 750 | 1500 |
| XXI | 2 | 49.1 | 750 | 1000 |
| XXII | 11+ | 45.1 | 700/550 | 1000 |
| XXIII | 14+ | 47.8 | 700/550 | 1500 |
| XXIV | 18+ | 42.9 | 700/500 | 2500 |
| XXV | 35+ | 43.8 | 770 | 1000 |

Reactor Yield is the product of the 700° F. bottoms yield in w % times the oil content weight fraction.

From the above Table, it is apparent that high Reactor Yield is attained in all runs. Operation using two stages (Examples XXII-XXIV) permits attainment of product characterized by particularly high UV Stability. In the case of Example XXV, it should be noted that the values reported are those attained after the product of this invention was solvent refined; and this resulted in a significant increase in UV Stability.

It may also be noted that although the products of Examples XX-XXI are of course characterized by high Reactor Yield, improved Pour Point, decreased Wax Content, and high Viscosity Index, the lower UV stability of these products may readily be improved by solvent refining or hydrofinishing.

Prior art hydrocracking processes which attempt to prepare stabilized product find it necessary to utilize a separate hydrogenation step or a separate solvent extraction step. Although it is possible to effect further stabilization of the products of the process of this invention by solvent extraction, it is unexpectedly found that the use of a second lower temperature hydrogenation/-stabilization improves UV stability and eliminates the need (as is taught by the prior art) for intermediate separation and purification steps between the first conversion operation and the stabilization operation.

Although this invention has been illustrated by reference to specific embodiments, it will be apparent to those skilled in the art that various charges and modifications may be made which clearly fall within the scope of the invention.

What is claimed is:

1. The process for converting a waxy hydrocarbon charge of high Pour Point and containing at least about 40 w % paraffins to a hydrocarbon lube oil base stock product, of reduced Pour Point and high viscosity index, which comprises maintaining a bed of sulfur-tolerant catalyst, on a support of silica, alumina, silica-alumina, magnesia, or magnesia-alumina, containing 2-10 2 % non-noble Group VIII metal, 5-30 w % Group VI B metal, 0-2 w % phosphorus and 0-10 w % of halogen characterized by a Total Surface Area of 100-250 $m^2/g$ and a pore size distribution as follows:

| Pore Size | Pore Volume cc/g |
|---|---|
| <100 Å | 0.20-0.50 |
| 100-160 Å | 0.01-0.05 |
| >160 Å | 0.01-0.10 |

and a Pore Mode of 60Å-100Å diameter;

passing waxy hydrocarbon charge of high Pour Point and containing at least 100 wppm sulfur and at least about 40 w % paraffins to said bed of catalyst;

maintaining said bed of catalyst at wax conversion conditions including temperature of 550° F.-900° F., pressure of 300-5000 psig, space velocity LHSV of 0.1-10, and hydrogen feed rate of 500-10,000 SCFB thereby converting said waxy hydrocarbon charge of high Pour Point and containing at least about 100 wppm sulfur and at least about 40 w % paraffins to a hydrocarbon lube oil base stock product, of reduced Pour Point and high viscosity index; and recovering said hydrocarbon lube oil base stock product of reduced Pour Point and high viscosity index.

2. The process of claim 1 wherein said waxy hydrocarbon charge of high Pour Point and containing at least about 40 w % paraffins is characterized by a Pour Point of 80° F. -120° F.+.

3. The process of claim 1 wherein said waxy hydrocarbon charge of high Pour Point and containing at least about 40 w % paraffins is a slack wax.

4. The process of claim 1 wherein said waxy hydrocarbon charge of high Pour Point and containing at least about 40 w % paraffins is a slack wax containing 55-95 w % paraffins.

5. The process for converting a waxy hydrocarbon charge of high Pour Point and containing at least about 40 w % paraffins to a hydrocarbon lube oil base stock product, of reduce Pour Point and high viscosity index as claimed in claim 1 wherein said waxy hydrocarbon charge of high pour point is the soft wax obtained from deoiling of (i) slack wax, (ii) high wax-content distillates, or (iii) deasphalted oil.

6. The process for converting a waxy hydrocarbon charge of high Pour Point and containing at least about 40 w % paraffins to a hydrocarbon lube oil base stock product, of reduced Pour Point and high viscosity index as claimed in claim 1 wherein said waxy hydrocarbon charge of high pour point is a solvent extracted distillate or a solvent extracted deasphalted oil.

7. The process of claim 1 wherein said wax conversion conditions include temperature of 650° F.-850° F.

8. The process of claim 1 wherein said wax conversion conditions include pressure of 1000-2500 psig.

9. The process of claim 1 wherein said catalyst contains support bearing 3-8 w % non-noble Group VIII metal, 10-25 w % Group VI B metal, and 0.5-10 w % halogen.

10. The process for converting a waxy hydrocarbon charge of high Pour Point and containing at least about 40 w % paraffins to a hydrocarbon lube oil base stock product, of reduced Pour Point and high viscosity index as claimed in claim 1 wherein the hydrocarbon product is further solvent extracted and thereafter solvent dewaxed thereby producing a stabilized product of further reduced Pour Point.

11. The process for converting a waxy hydrocarbon charge of high Pour Point and containing at least about 40 w % paraffins to a hydrocarbon lube oil base stock product, of reduced Pour Point and high viscosity index as claimed in claim 1 wherein the hydrocarbon product is further solvent dewaxed and thereafter solvent extracted thereby producing a stabilized product of further reduced Pour Point.

12. The process for converting a waxy hydrocarbon charge of high Pour Point and containing at least about 40 w % paraffins to a hydrocarbon lube oil base stock product, of reduced Pour Point and high viscosity index as claimed in claim 1 wherein the hydrocarbon product is further subjected to solvent refining and thereafter to catalytic dewaxing thereby producing a product of further reduced pour point and improved low temperature properties.

13. The process for converting a waxy hydrocarbon charge of high Pour Point and containing at least about 40 w % paraffins to a hydrocarbon lube oil base stock product, of reduced Pour Point and high viscosity index as claimed in claim 1 wherein the hydrocarbon product is further subjected to catalytic dewaxing and thereafter to solvent refining thereby producing a product of further reduced pour point and improved low temperature properties.

14. The process for converting a waxy hydrocarbon charge of high Pour Point and containing at least about 40 w % paraffins to a hydrocarbon lube oil base stock product, of reduced Pour Point and high viscosity index as claimed in claim 1 wherein said product oil is further treated by high pressure stabilization thereby stabilizing said product oil.

15. The process of claim 1 wherein the hydrocarbon lube oil base stock product of reduced pour point and high viscosity index is further subjected to solvent refining, and dewaxing thereby forming a product of improved stability to ultraviolet light; and recovering said product of improved stability to ultraviolet light.

16. The process for converting a waxy hydrocarbon charge of high Pour Point and containing at least about 40 w % paraffins to a hydrocarbon lube oil base stock product, of reduced Pour Point and high viscosity index which comprises maintaining a first and a second bed of sulfur-tolerant catalyst, on a support of silica, alumina, silica-alumina, magnesia, or magnesia-alumina, containing 2-10 w % non-noble Group VIII metal, 5-30 w % Group VI B metal, 0-2 w % phosphorus and 0-10 w % of halogen characterized by a Total Surface Area of 100-250 $m^2/g$ and a pore size distribution as follows:

| Pore Size | Pore Volume cc/g |
|---|---|
| <100Å | 0.20-0.50 |
| 100-160Å | 0.01-0.05 |
| >160Å | 0.01-0.10 |

and a Pore Mode of 60Å-90Å diameter;

passing waxy hydrocarbon charge of high Pour Point and containing at least 100 wppm sulfur and at least about 40 w % paraffins to said first bed of catalyst;

maintaining said first bed of catalyst at wax conversion conditions including temperature of 550° F.-900° F., pressure of 300-5000 psig, space velocity LHSV of 0.1-10, and hydrogen feed rate of 500-10,000 SCFB thereby converting said waxy hydrocarbon charge of high Pour Point and containing at least about 40 w % paraffins to a first hydrocarbon lube oil base stock product, of reduced Pour Point and high viscosity index;

recovering said first hydrocarbon lube oil base stock product of reduced Pour Point and high viscosity index;

passing said first hydrocarbon product to said second bed of catalyst;

maintaining said second bed of catalyst at temperature 100° F.-300° F. lower than the temperature of said first bed, at pressure of 300-5000 psig, space velocity LHSV o 0.1-10, and hydrogen feed rate of 5,000-10,000 SCFB thereby converting said first hydrocarbon product to a second hydrocarbon product particularly characterized by improved stability to ultraviolet light; and recovering said second hydrocarbon product.

17. The process of claim 16 wherein said first hydrocarbon product is passed to said second bed of catalyst without intermediate processing.

18. The process for converting a waxy hydrocarbon charge of high Pour Point and containing at least about 40 w % paraffins to a hydrocarbon lube oil base stock product, of reduced Pour Point and high viscosity index which comprises maintaining a bed of sulfur-tolerant catalyst, on a support of silica, alumina, silica-alumina, magnesia, or magnesia-alumina, containing 2-10 w % non-noble Group VIII metal, 5-30 w % Group VI B metal, 0-2 w % phosphorus and 0.5-10 w % of halogen characterized by a Total Surface Area of 100-250 $m^2/g$ and a pore size distribution as follows:

| Pore Size | Pore Volume cc/g |
|---|---|
| <100Å | 0.20-0.50 |
| 100-160Å | 0.01-0.05 |
| >160Å | 0.01-0.10 |

and a Pore Mode of 60Å-100Å diameter;

passing waxy hydrocarbon charge of high Pour Point and containing at least 100 wppm sulfur and at least about 40 w % paraffins to said bed of catalyst;

maintaining said bed of catalyst at wax conversion conditions including temperature of 550° F. -900° F., pressure of 300-5000 psig, space velocity LHSV of 0.1-10, and hydrogen feed rate of 500–10,000 SCFB thereby converting said waxy hydrocarbon charge of high Pour Point and containing at least about 100 wppm sulfur and at least about 40 w % paraffins to a hydrocarbon lube oil base stock product, of reduced Pour Point and high viscosity index; and recovering said hydrocarbon lube oil base stock product of reduced Pour Point and high viscosity index.

* * * * *